US010016870B1

(12) United States Patent
Wu

(10) Patent No.: US 10,016,870 B1
(45) Date of Patent: Jul. 10, 2018

(54) HANDHOLD SHARPENING TOOL

(71) Applicant: Jiin Haur Industrial Co., Ltd., Lukang Township, Changhua County (TW)

(72) Inventor: Shih-Paio Wu, Lu Kang Town (TW)

(73) Assignee: Jin Haur Industrial Co., Ltd., Lukang Township (TW)

( * ) Notice: Subject to any disclaimer, the term of this patent is extended or adjusted under 35 U.S.C. 154(b) by 36 days.

(21) Appl. No.: 15/383,037

(22) Filed: Dec. 19, 2016

(51) Int. Cl.
*B24B 3/54* (2006.01)

(52) U.S. Cl.
CPC ..... *B24B 3/543* (2013.01)

(58) Field of Classification Search
CPC ..... B24B 3/543; B24B 3/54; B24B 23/00; B24D 15/00
USPC ..... 451/349, 45, 461, 462, 552, 556, 557, 451/558; 76/82, 82.2, 86, 88
See application file for complete search history.

(56) References Cited

U.S. PATENT DOCUMENTS 5,046,385 A * 9/1991 Cozzini ..... B24D 15/081 451/461
5,291,805 A * 3/1994 Byers ..... B24D 15/081 76/82.2
5,477,753 A * 12/1995 Branscum ..... B24D 15/08 451/552
5,679,068 A * 10/1997 Byers ..... B24D 15/081 451/557
7,066,796 B2 * 6/2006 Pfaus ..... B24D 15/06 451/344
7,229,344 B1 * 6/2007 Wu ..... B24D 15/065 451/349
8,221,199 B2 * 7/2012 Smith ..... B24B 3/54 451/461
8,943,698 B2 * 2/2015 Hirai ..... B24D 15/084 30/138
2007/0266828 A1 * 11/2007 Byers ..... B24D 15/065 76/82

* cited by examiner

*Primary Examiner* — Robert Rose
(74) *Attorney, Agent, or Firm* — Alan D. Kamrath; Kamrath IP Lawfirm, P.A.

(57) ABSTRACT

A sharpening tool includes a main body, a first grindstone unit, a second grindstone unit, a stop plate, a blade and a sharpening bar. The main body has a grip and an extension neck. The grip has a receiving space and a receiving channel. The extension neck has an arc-shaped profile and has a first positioning recess and a second positioning recess. The first grindstone unit is mounted in the first positioning recess. The second grindstone unit is mounted in the second positioning recess. The stop plate is pivotally mounted on the main body and has two pivot ears and an opening. The blade is pivotally mounted on the main body and received in the receiving channel. The sharpening bar is inserted into the receiving space.

3 Claims, 8 Drawing Sheets

HANDHOLD SHARPENING TOOL

BACKGROUND OF THE INVENTION

1. Field of the Invention

The present invention relates to a sharpening tool and, more particularly, to a knife sharpener that is held by a user.

2. Description of the Related Art

A conventional knife sharpener 90 in accordance with the prior art shown in FIGS. 7 and 8 comprises a handle 91, a head 92 extending from the front end of the handle 91, and a grindstone 93 mounted on a side of the head 92. When in use, the handle 91 is held by a user's hand, and the grindstone 93 is moved relative to a cutting edge so as to grind and sharpen the cutting edge. However, the force applying direction of the knife sharpener 90 on the cutting edge is different from the movement direction of the knife sharpener 90, so that the user has to exert a larger force on the handle 91 to grind and sharpen the cutting edge. On the other hand, when the knife sharpener 90 is used to sharpen a pair of gardening shears, the cutting edge of the gardening shears has an arcuate shape, and the jaw of the gardening shears interferes with movement of the knife sharpener 90, so that the knife sharpener 90 cannot be operated easily and conveniently. In addition, the grindstone 93 of the knife sharpener 90 does not cover and grind the whole cutting edge completely, so that it is necessary to perform the sharpening action in a stepwise manner as shown in FIG. 8. Further, the curvature at the distal end of the cutting edge is changed sharply, so that when the grindstone 93 is moved to the distal end of the cutting edge, the grindstone 93 easily slips from the cutting edge, thereby causing inconvenience to the user.

BRIEF SUMMARY OF THE INVENTION

The primary objective of the present invention is to provide a sharpening tool that is available for various cutters, such as a pair of gardening shears, a pair of scissors, a knife and the like.

In accordance with the present invention, there is provided a sharpening tool comprising a main body, a first grindstone unit, a second grindstone unit, a stop plate, a blade and a sharpening bar. The main body has a grip and an extension neck. The grip has a front portion provided with a first pivot hole extending through the grip and a rear portion provided with a second pivot hole extending through the grip. The grip is provided with a plurality of positioning dents located outside of the first pivot hole. The grip has an upper portion provided with a receiving space and a lower portion provided with a receiving channel. The extension neck has a front end provided with a first positioning recess and a lower portion provided with a second positioning recess adjacent to the grip. The extension neck has an arc-shaped profile and has an upper arcuate face and a lower arcuate face. The first grindstone unit is mounted in the first positioning recess of the main body, with the grip, the extension neck and the first grindstone unit being arranged on a line in the same direction. The second grindstone unit is mounted in the second positioning recess of the main body. The stop plate is pivotally mounted on the grip of the main body and has an end provided with two pivot ears and an opening defined between the two pivot ears. The two pivot ears of the stop plate align with the first pivot hole of the main body. A pivot shaft extends through the two pivot ears of the stop plate and the first pivot hole of the main body, so that the stop plate is pivotally mounted on the grip of the main body. Each of the two pivot ears of the stop plate has an inner face provided with a positioning boss positioned in one of the positioning dents of the main body, so that the stop plate is positioned on the main body. The blade is pivotally connected with the second pivot hole of the main body. Thus, the blade is pivoted outward from the grip of the main body or fully folded into the receiving channel of the grip. The sharpening bar is inserted into the receiving space of the main body and can be drawn outward from the receiving space of the main body.

According to the primary advantage of the present invention, the grip, the extension neck and the first grindstone unit are arranged on a line in the same direction, the extension neck extends into the opening of the gardening shears, the curvature of the upper arcuate face escapes the shape of the cutting edge and the jaw of the gardening shears, so that when the sharpening tool is moved relative to the gardening shears, the force applying direction of the sharpening tool on the gardening shears is the same as the movement direction of the sharpening tool, such that the pressing force of the sharpening tool is directed in the same direction to move the first grindstone unit 20 on the cutting edge completely, so as to sharpen the cutting edge quickly and conveniently.

According to another advantage of the present invention, the force of the sharpening tool on the gardening shears directly presses the cutting edge of the gardening shears, thereby saving the user's energy.

According to a further advantage of the present invention, the stop plate is pivoted outward to stop the cutting edge of the gardening shears, thereby preventing the user from being hurt by the cutting edge of the gardening shears.

According to a further advantage of the present invention, the second grindstone unit abuts and moves relative to the cutting edge of the knife to sharpen the cutting edge of the knife, and the grip of the main body is perpendicular to the knife, thereby spacing the user's hand from the cutting edge of the knife.

According to a further advantage of the present invention, the sharpening bar can be drawn outward from the receiving space of the main body to grind and sharpen different cutting tools.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
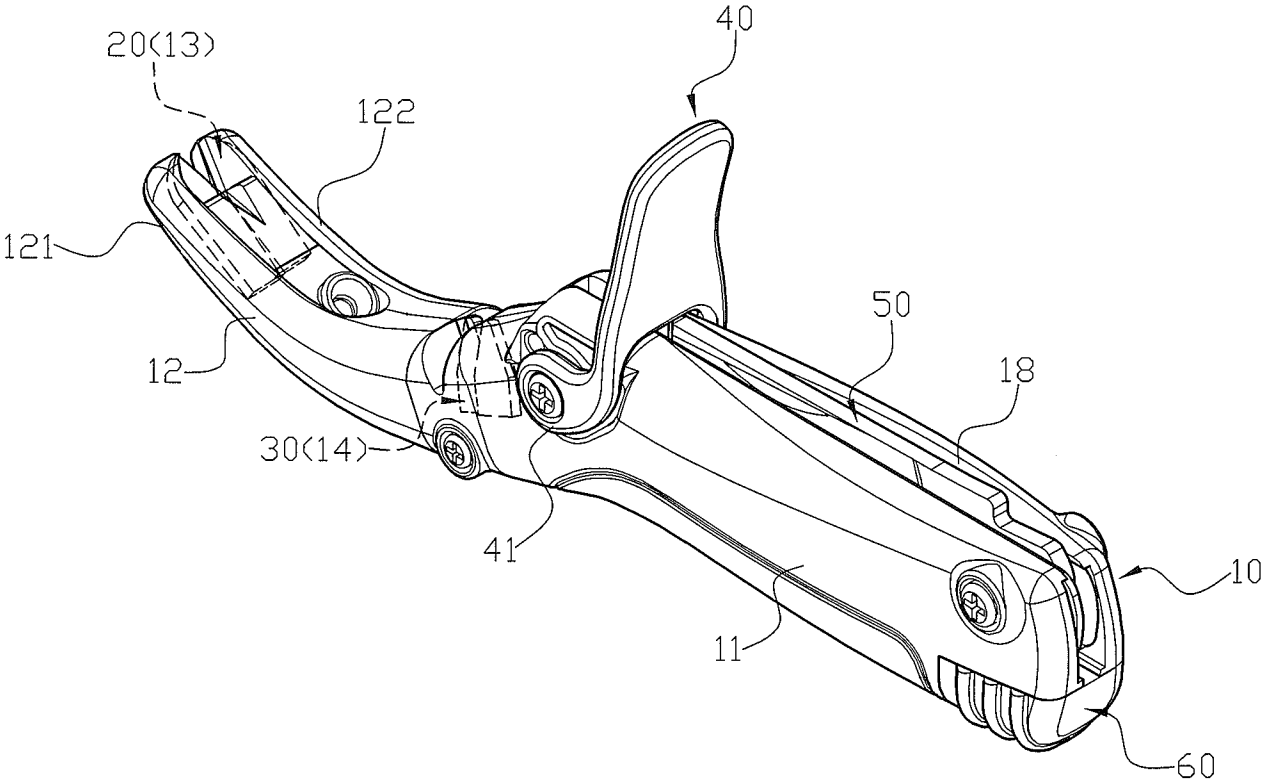
FIG. 1 is a perspective view of a sharpening tool in accordance with the preferred embodiment of the present invention.
Figure 2:
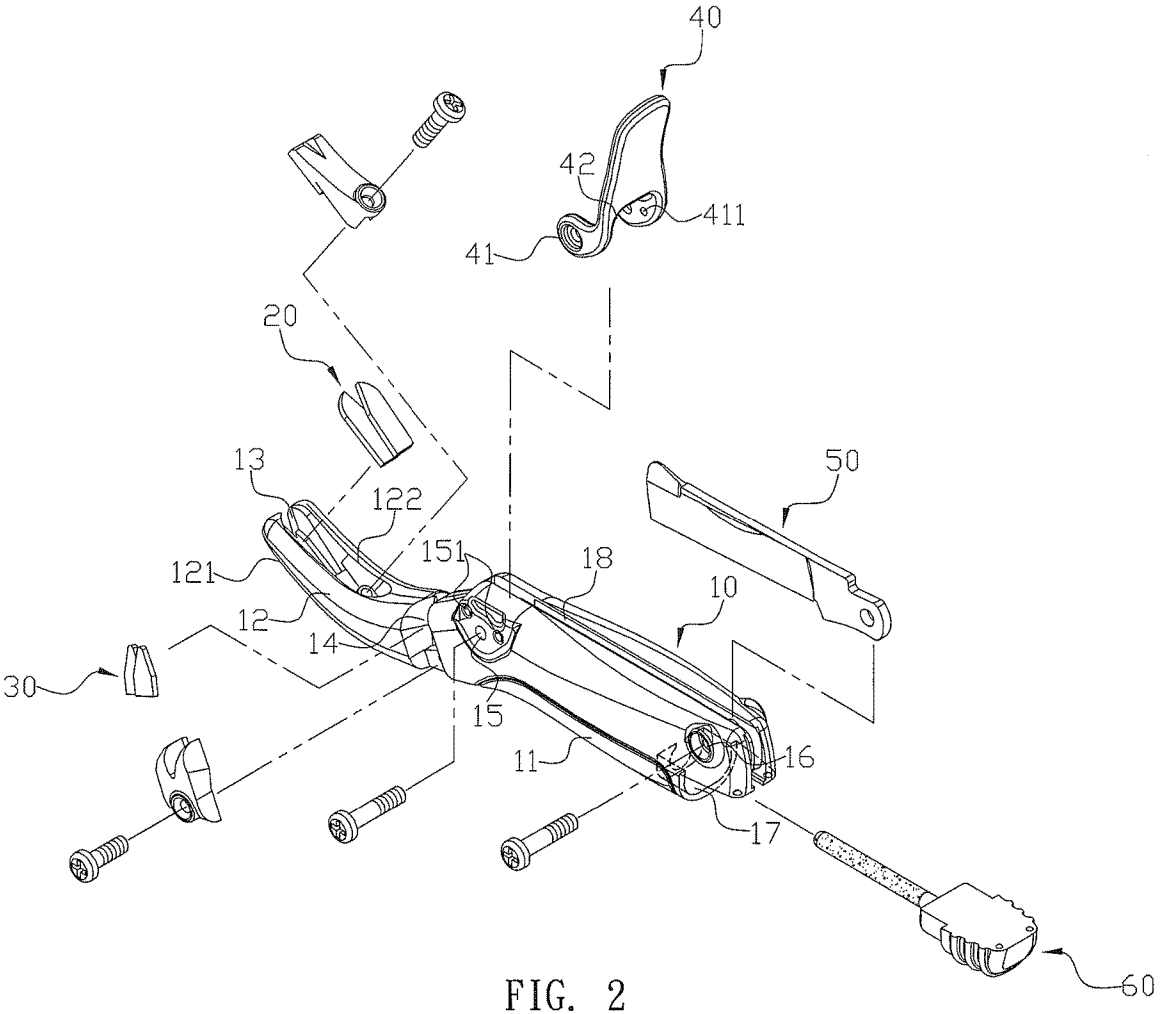
FIG. 2 is an exploded perspective view of the sharpening tool in accordance with the preferred embodiment of the present invention.
Figure 3:
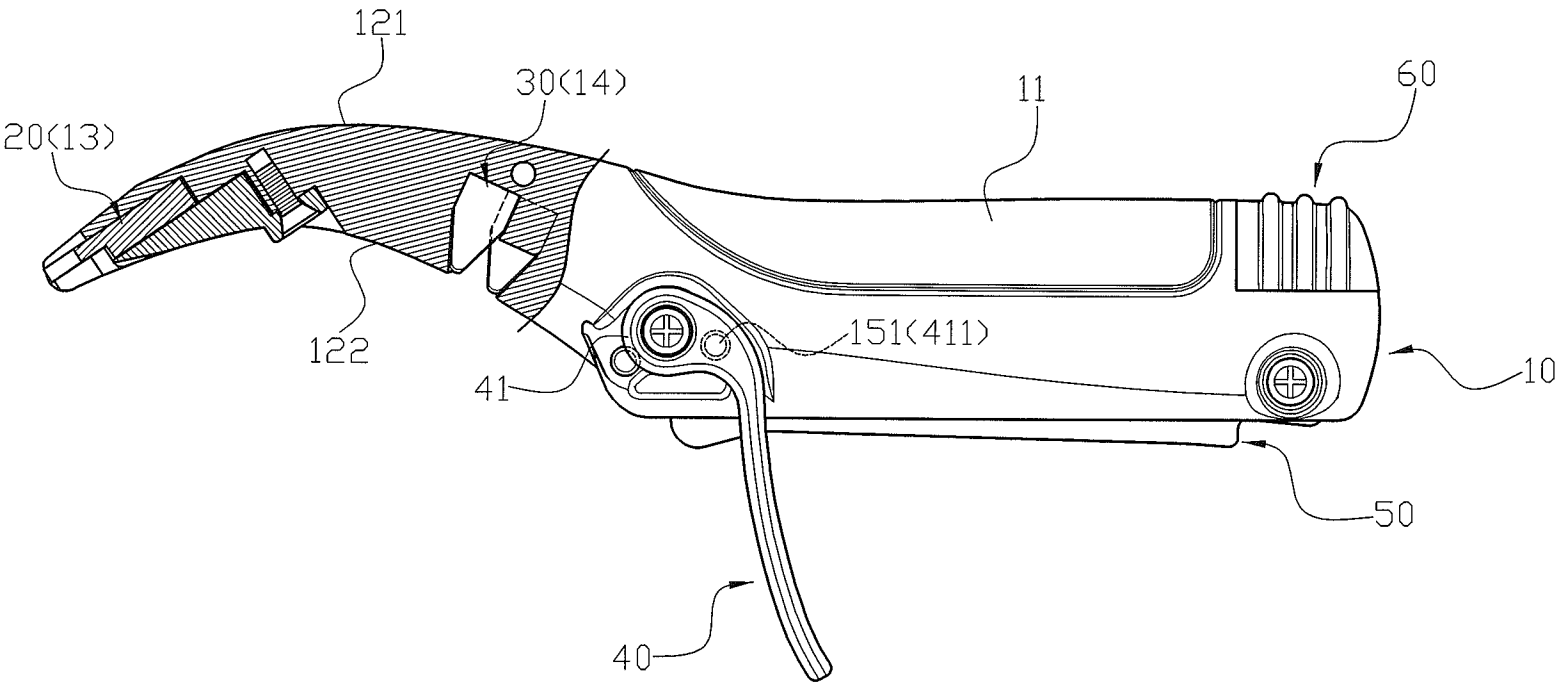
FIG. 3 is a partially cross-sectional assembly view of the sharpening tool in accordance with the preferred embodiment of the present invention.

Referring to the drawings and initially to FIGS. 1-3, a sharpening tool in accordance with the preferred embodiment of the present invention comprises a main body 10, a first grindstone unit 20, a second grindstone unit 30, a stop plate 40, a blade 50 and a sharpening bar 60.

The main body 10 has a grip 11 and an extension neck 12. The grip 11 has a front portion provided with a first pivot hole 15 extending through the grip 11 and a rear portion provided with a second pivot hole 16 extending through the grip 11. The grip 11 is provided with a plurality of positioning dents 151 located outside of the first pivot hole 15. The grip 11 has an upper portion provided with a receiving space 17 and a lower portion provided with a receiving channel 18. The upper and lower portions of the grip 11 are defined by the operation direction as shown in FIGS. 3-6. The extension neck 12 integrally extends from the front portion of the grip 11 and has a front end provided with a first positioning recess 13 and a lower portion provided with a second positioning recess 14 adjacent to the grip 11. The second positioning recess 14 of the main body 10 is located at a mediate position of the main body 10. The extension neck 12 has an arc-shaped profile and has an upper arcuate face 121 and a lower arcuate face 122.

The first grindstone unit 20 is mounted in the first positioning recess 13 of the main body 10, with the grip 11, the extension neck 12 and the first grindstone unit 20 being arranged on a line in the same direction.

The second grindstone unit 30 is mounted in the second positioning recess 14 of the main body 10.

The stop plate 40 is pivotally mounted on the grip 11 of the main body 10 and has an end provided with two pivot ears 41 and an opening 42 defined between the two pivot ears 41. The two pivot ears 41 of the stop plate 40 align with the first pivot hole 15 of the main body 10. A pivot shaft extends through the two pivot ears 41 of the stop plate 40 and the first pivot hole 15 of the main body 10, so that the stop plate 40 is pivotally mounted on the grip 11 of the main body 10. Each of the two pivot ears 41 of the stop plate 40 has an inner face provided with a positioning boss 411 positioned in one of the positioning dents 151 of the main body 10, so that the stop plate 40 is positioned on the main body 10.

The blade 50 is pivotally connected with the second pivot hole 16 of the main body 10. Thus, the blade 50 is pivoted outward from the grip 11 of the main body 10 or fully folded into the receiving channel 18 of the grip 11.

The sharpening bar 60 is inserted into the receiving space 17 of the main body 10 and can be drawn outward from the receiving space 17 of the main body 10.

In the preferred embodiment of the present invention, the first grindstone unit 20 includes two grindstones overlapping each other so that the first grindstone unit 20 has a substantially V-shaped grinding notch.

In the preferred embodiment of the present invention, the second grindstone unit 30 includes two grindstones overlapping each other so that the second grindstone unit 30 has a substantially V-shaped grinding notch.

Figure 4:
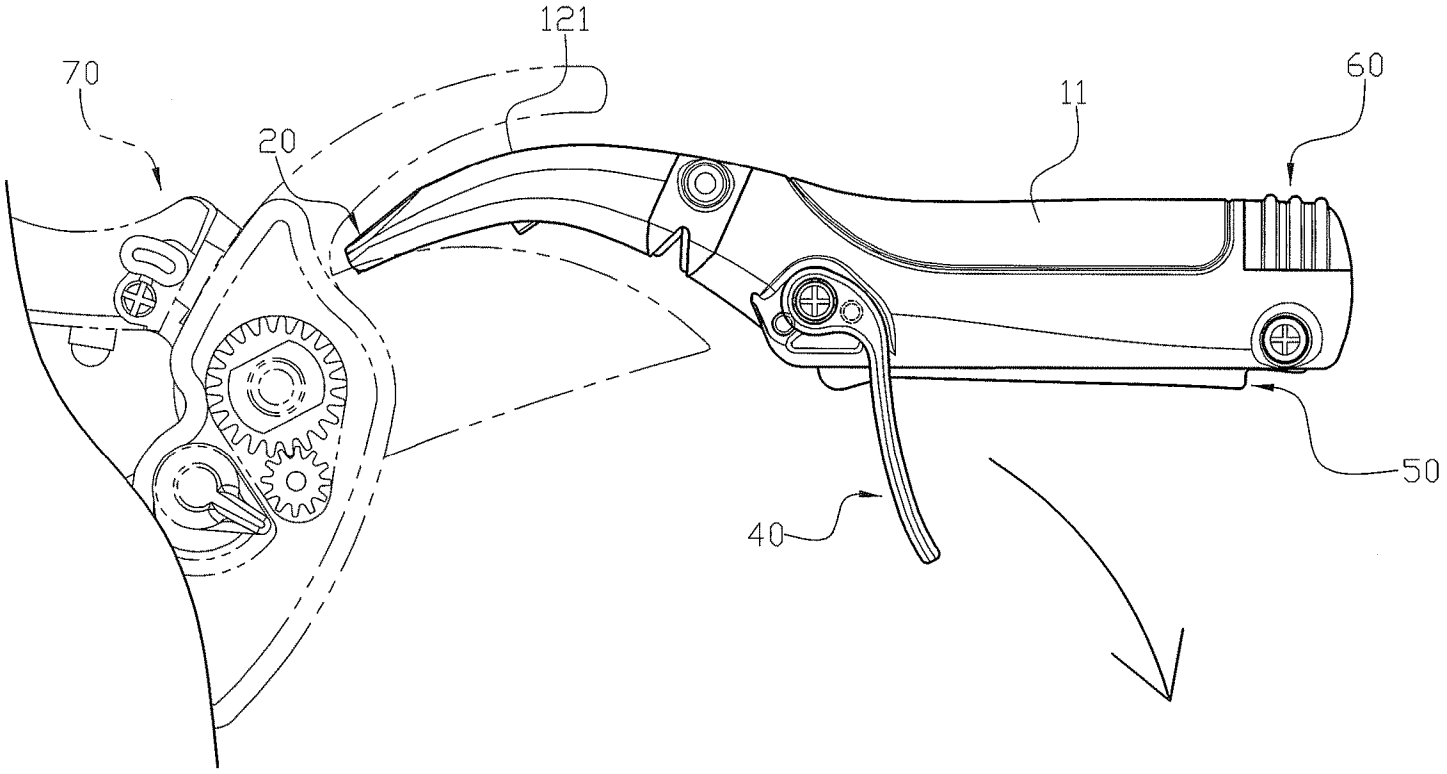
FIG. 4 is a schematic operational view of the sharpening tool for a pair of gardening shears.
Figure 5:
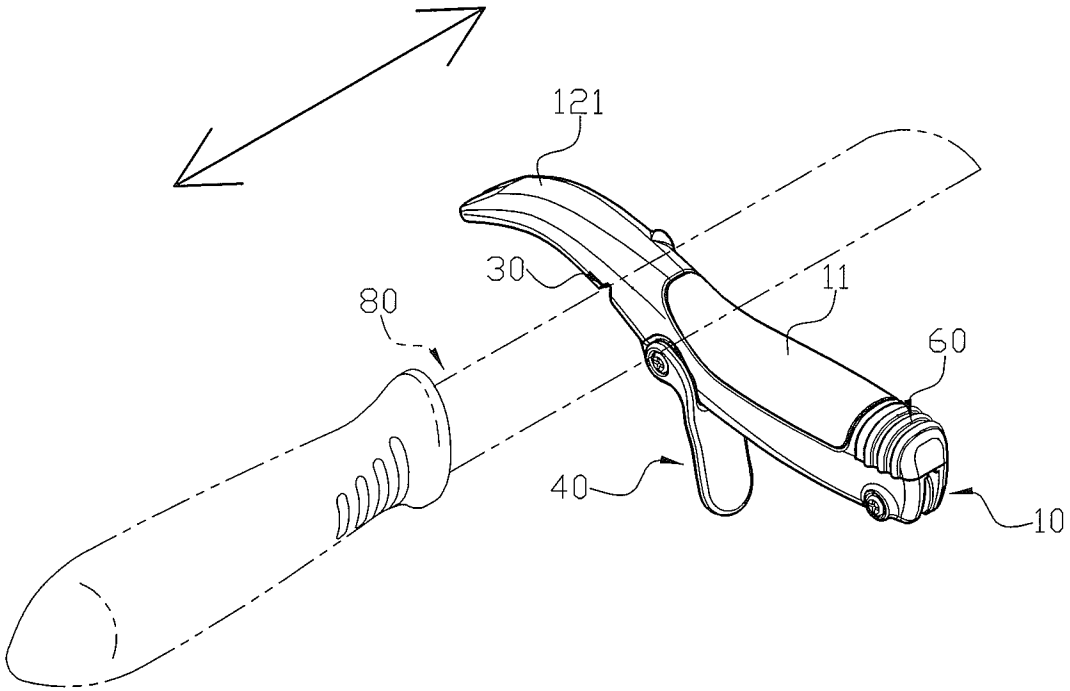
FIG. 5 is a schematic operational view of the sharpening tool for a knife.

In operation, referring to FIGS. 4 and 5 with reference to FIGS. 1-3, when a pair of gardening shears 70 is to be sharpened as shown in FIG. 4, the grip 11 of the main body 10 is aligned with the opened gardening shears 70, the extension neck 12 of the main body 10 extends into the opening of the gardening shears 70, the curvature of the extension neck 12 and the upper arcuate face 121 of the main body 10 escapes the shape of the cutting edge and the jaw of the gardening shears 70, and the first positioning recess 13 of the main body 10 and the first grindstone unit 20 are arranged in the inner side of the cutting edge of the gardening shears 70. In such a manner, when the sharpening tool is moved relative to and applies a pressing force on the gardening shears 70, the force applying direction of the sharpening tool on the gardening shears 70 is the same as the movement direction of the sharpening tool, so that the pressing force of the sharpening tool is directed in the same direction to move the first grindstone unit 20 on the cutting edge of the gardening shears 70 reciprocally and completely, so as to sharpen the cutting edge of the gardening shears 70 exactly. At this time, the stop plate 40 is pivoted outward from the grip 11 of the main body 10 to align with the cutting edge of the gardening shears 70, thereby preventing the user from being hurt by the cutting edge of the gardening shears 70.

Alternatively, when a knife 80 is to be sharpened as shown in FIG. 5, the grip 11 of the main body 10 is perpendicular to the knife 80. At this time, the cutting edge of the knife 80 extends to the second positioning recess 14 of the main body 10 and abuts the second grindstone unit 30. In such a manner, when the sharpening tool is moved relative to and applies a pressing force on the knife 80, the second grindstone unit 30 is moved on the cutting edge of the knife 80 reciprocally so as to sharpen the cutting edge of the knife 80 exactly.

Figure 6:
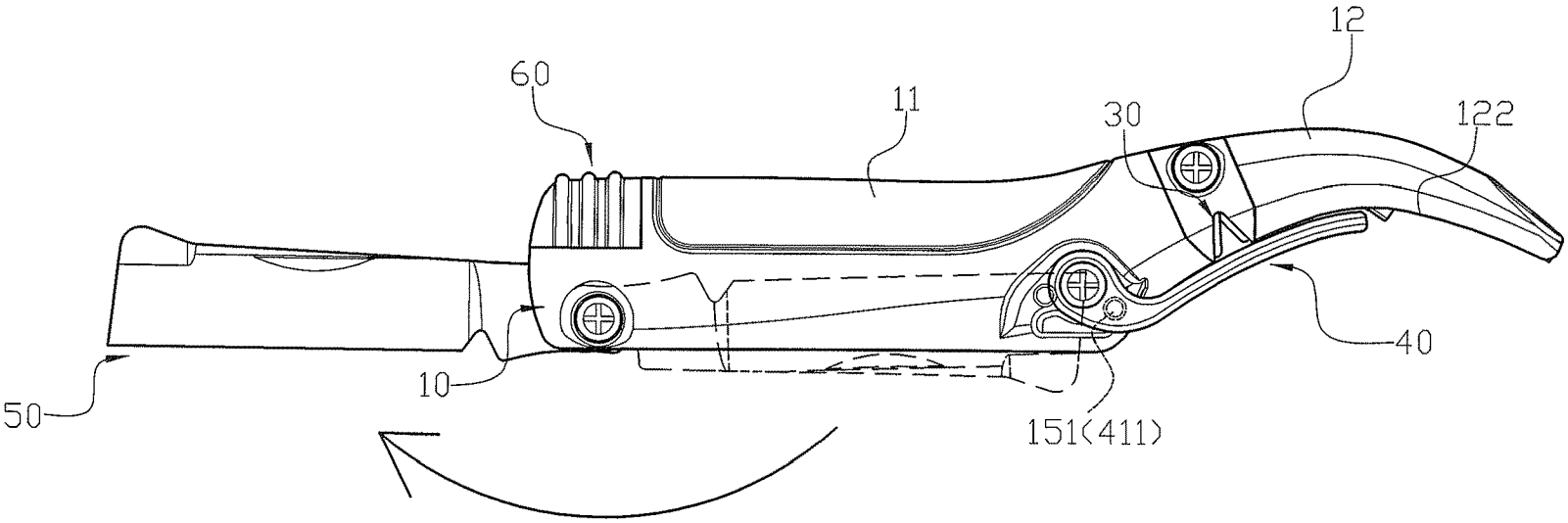
FIG. 6 is a schematic operational view showing the blade being pivoted outward.
Figure 7:
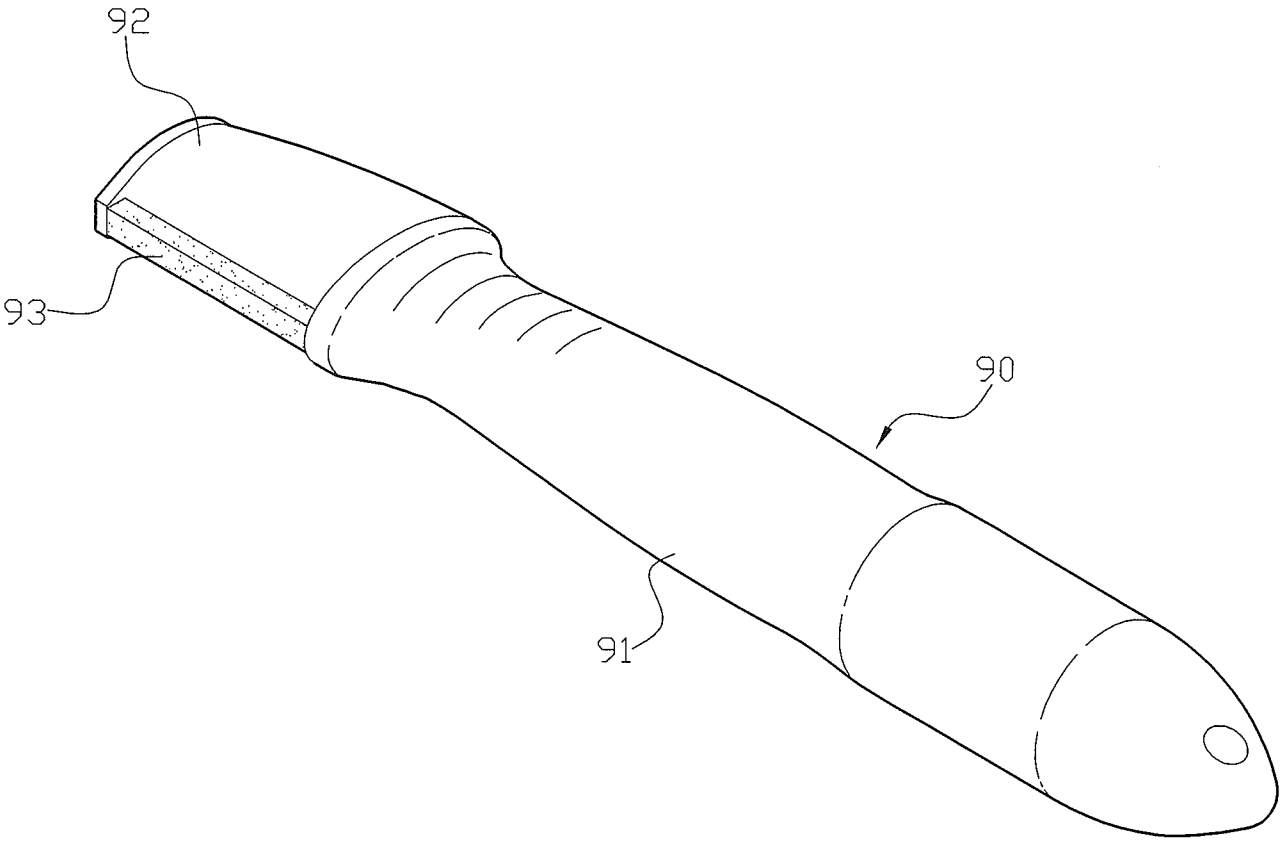
FIG. 7 PRIOR ART
FIG. 7 is a perspective view of a conventional knife sharpener in accordance with the prior art.
Figure 8:
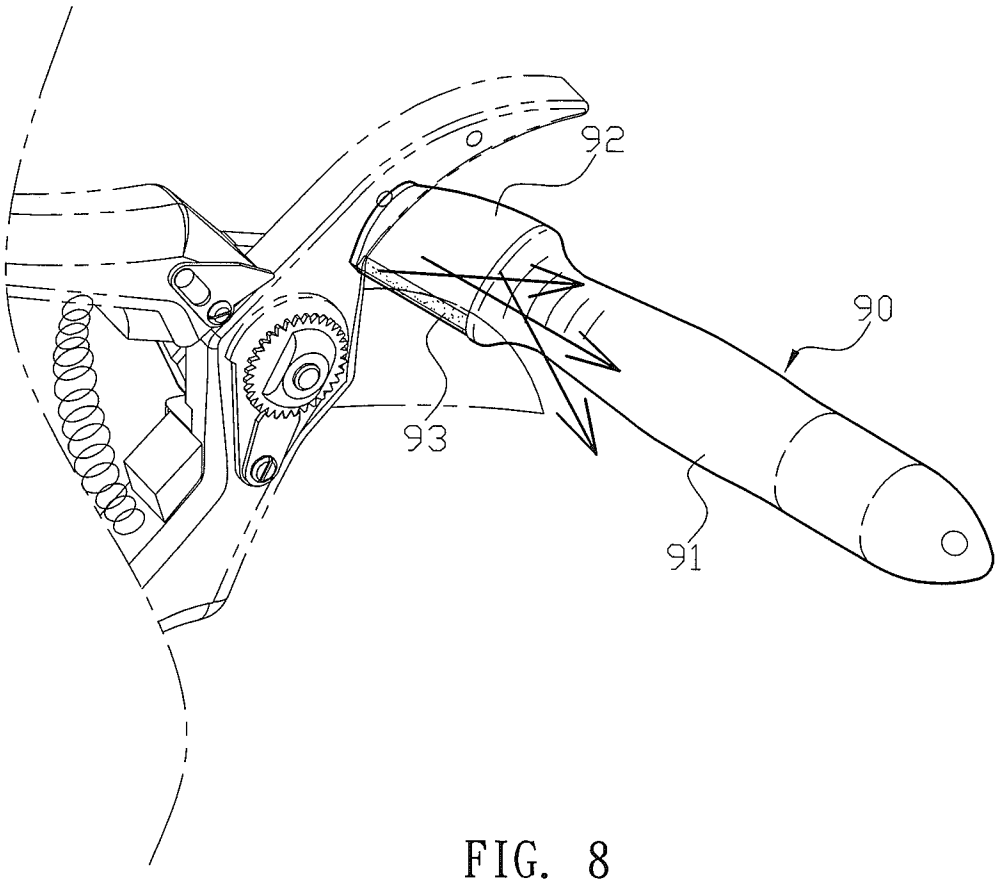
FIG. 8 PRIOR ART
FIG. 8 is a schematic operational view of the conventional knife sharpener.

As shown in FIG. 6, the stop plate 40 is pivoted to abut the lower arcuate face 122 of the main body 10 to release the blade 50, so that the blade 50 is pivoted relative to the second pivot hole 16 of the main body 10 and can be pivoted outward from the receiving channel 18 to perform a cutting function. In addition, the sharpening bar 60 can be drawn outward from the receiving space 17 of the main body 10 to grind and sharpen different cutting tools.

Accordingly, the grip 11, the extension neck 12 and the first grindstone unit 20 are arranged on a line in the same direction, the extension neck 12 extends into the opening of the gardening shears 70, the curvature of the upper arcuate face 121 escapes the shape of the cutting edge and the jaw of the gardening shears 70, so that when the sharpening tool is moved relative to the gardening shears 70, the force applying direction of the sharpening tool on the gardening shears 70 is the same as the movement direction of the sharpening tool, such that the pressing force of the sharpening tool is directed in the same direction to move the first grindstone unit 20 on the cutting edge completely, so as to sharpen the cutting edge quickly and conveniently. In addition, the force of the sharpening tool on the gardening shears 70 directly presses the cutting edge of the gardening shears 70, thereby saving the user's energy. Further, the stop plate 40 is pivoted outward to stop the cutting edge of the gardening shears 70, thereby preventing the user from being hurt by the cutting edge of the gardening shears 70. Further, the second grindstone unit 30 abuts and moves relative to the cutting edge of the knife 80 to sharpen the cutting edge of the knife 80, and the grip 11 of the main body 10 is perpendicular to the knife 80, thereby spacing the user's hand from the cutting edge of the knife 80. Further, the sharpening bar 60 can be drawn outward from the receiving space 17 of the main body 10 to grind and sharpen different cutting tools.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A sharpening tool comprising:

a main body, a first grindstone unit, a second grindstone unit, a stop plate, a blade and a sharpening bar;

wherein:

the main body has a grip and an extension neck;

the grip has a front portion provided with a first pivot hole extending through the grip and a rear portion provided with a second pivot hole extending through the grip;

the grip is provided with a plurality of positioning dents located outside of the first pivot hole;

the grip has an upper portion provided with a receiving space and a lower portion provided with a receiving channel;

the extension neck has a front end provided with a first positioning recess and a lower portion provided with a second positioning recess adjacent to the grip;

the extension neck has an arc-shaped profile and has an upper arcuate face and a lower arcuate face;

the first grindstone unit is mounted in the first positioning recess of the main body, with the grip, the extension neck and the first grindstone unit being arranged on a line in the same direction;

the second grindstone unit is mounted in the second positioning recess of the main body;

the stop plate is pivotally mounted on the grip of the main body and has an end provided with two pivot ears and an opening defined between the two pivot ears;

the two pivot ears of the stop plate align with the first pivot hole of the main body;

a pivot shaft extends through the two pivot ears of the stop plate and the first pivot hole of the main body, so that the stop plate is pivotally mounted on the grip of the main body;

each of the two pivot ears of the stop plate has an inner face provided with a positioning boss positioned in one of the positioning dents of the main body, so that the stop plate is positioned on the main body;

the blade is pivotally connected with the second pivot hole of the main body;

the blade is pivoted outward from the grip of the main body or fully folded into the receiving channel of the grip; and the sharpening bar is inserted into the receiving space of the main body and can be drawn outward from the receiving space of the main body.

2. The sharpening tool of claim 1, wherein the first grindstone unit includes two grindstones overlapping each other so that the first grindstone unit has a substantially V-shaped grinding notch.

3. The sharpening tool of claim 1, wherein the second grindstone unit includes two grindstones overlapping each other so that the second grindstone unit has a substantially V-shaped grinding notch.

* * * * *